US005801741A

United States Patent [19]

Ikegawa

[11] Patent Number: 5,801,741

[45] Date of Patent: Sep. 1, 1998

[54] ELECTROSTATIC RECORDING APPARATUS

[75] Inventor: Akihito Ikegawa, Sakai, Japan

[73] Assignee: Minolta Co., Ltd., Osaka, Japan

[21] Appl. No.: 842,066

[22] Filed: Apr. 23, 1997

[30] Foreign Application Priority Data

Apr. 24, 1996 [JP] Japan ..... 8-102152
May 22, 1996 [JP] Japan ..... 8-126986

[51] Int. Cl.[6] ..... B41J 2/39; B41J 2/395

[52] U.S. Cl. ..... 347/141; 347/112; 347/142

[58] Field of Search ..... 399/137, 135; 347/111, 112, 103, 154, 139, 141, 142; 346/33 A

[56] References Cited

U.S. PATENT DOCUMENTS

| | | | |
|---|---|---|---|
| 2,925,310 | 2/1960 | Perkins | 346/33 A |
| 3,186,839 | 6/1965 | Stone et al. | 346/33 A |
| 3,346,867 | 10/1967 | Schwarzer | 346/33 A X |
| 3,419,888 | 12/1968 | Levy | 347/111 |
| 3,550,155 | 12/1970 | De Rosa | 346/33 A X |
| 4,205,321 | 5/1980 | Blazey | 347/111 |
| 4,643,578 | 2/1987 | Stern . | |
| 4,731,853 | 3/1988 | Hata et al. . | |
| 4,993,835 | 2/1991 | Inoue et al. . | |
| 5,128,893 | 7/1992 | Takanashi et al. | 347/141 |
| 5,450,103 | 9/1995 | Kubelik | 347/139 X |
| 5,539,440 | 7/1996 | Higuchi et al. | 347/112 |

FOREIGN PATENT DOCUMENTS 1-293358 11/1989 Japan .

*Primary Examiner*—Matthew S. Smith
*Attorney, Agent, or Firm*—McDermott, Will & Emery

[57] ABSTRACT

An electrostatic recording apparatus 1 for forming an electrostatic image on an electric charge carrying member 2 includes a photoelectric transfer member 14, a pair of bias electrodes 12, 13, an electric power supply 17, a floating electrode 16 and an exposure means 8. The photoelectric transfer member 14 which generates carrier when being exposed to light is interposed between the bias electrodes 12, 13. One of the bias electrodes 12 is transparent. The electric power supply 17 applies a voltage between the bias electrodes 12, 13. The floating electrode 16 has a first area which comes into contact with the photoelectric transfer member 14 and a second area which is opposed to the electric charge carrying member 2. The floating electrode 16 is in no electrical connection with the bias electrodes 12, 13. The exposure means 8 exposes the photoelectric transfer member 14 through the transparent bias electrode 12 so that a carrier is generated in the photoelectric transfer member 14, thereby an electric discharge is caused from the second area of the floating electrode 16 to the electric charge carrying member 2 to form an electrostatic image on the electric charge carrying member 2.

13 Claims, 12 Drawing Sheets

ELECTROSTATIC RECORDING APPARATUS

BACKGROUND OF THE INVENTION

The present invention relates to an electrostatic recording apparatus used for an image forming apparatus, a printer and so on.

Conventionally, as an electric recording apparatus for forming an electrostatic image on an electric charge carrying member, a photosensitive member as shown in FIG. 14 is proposed in, for example, Japanese Patent Laid-Open Publication No. HEI 1-293358. The photosensitive member 101 is constructed by laminating a photoconductive layer support member 103, a photosensitive member electrode 104 and a photoconductive layer 105 in this order. On the other hand, the electric charge carrying member 102 has a rotatable cylindrical configuration and is constructed by laminating an insulating layer support member 106, an electric charge carrying member electrode 107 and an insulating layer 108 in this order. The photosensitive member 101 and the electric charge carrying member 102 are arranged so that the photoconductive layer 103 and the insulating layer 108 face each other via an air gap.

By applying a voltage between the photosensitive member electrode 104 and the electric charge carrying member electrode 107 and performing scanning in the axial direction (main scanning direction) of the electric charge carrying member 102 with light incident on the photosensitive member 101 in a dark place, a portion of the photoconductive layer 105 exposed to the light comes to have a conductivity. Thus, an electric discharge is generated between the exposed portion and the insulating layer 108 of the electric charge carrying member 102, so that electric charges are accumulated in the insulating layer 108 of the electric charge carrying member 102 to form an electrostatic latent image. The formed electrostatic latent image is moved in a direction indicated by an arrow "b" in FIG. 14 to develop into a toner image by a developing unit 109. The toner image is transferred onto a paper or a film by a transfer charger 110.

However, when forming an image with the aforementioned apparatus as shown in FIG. 14, there is a possibility that a dot-like image is formed, or that a rear end portion of the image is elongated, which results in difficulty of obtaining a stable image. This is considered to be caused by the reason that a fast and stable electric discharge does not occur, or that an electric discharge is intermittently carried out or continuously carried out after completion of exposure.

SUMMARY OF THE INVENTION

An object of the present invention is to eliminate the intermittent electric discharge or the continuous electric discharge after completion of exposure and to provide an electrostatic recording apparatus in which a fast and stable electric discharge is carried out.

The present inventor investigate the cause of the intermittent of the image and the elongation of the image rear end portion. As a result, it is found out that when the intensity of electric field applied to the photosensitive member is small, movement of carriers generated in the exposed area of the photosensitive member becomes slower, all of the carriers are not spent fast to the electric discharge, or the generated carriers become disappeared. It is also found that in the apparatus as shown in FIG. 14, since one of the electrodes for generating an electric field in the photoconductive layer 105, that is, the electric charge carrying member electrode 107 is separately constructed from the photoconductive layer 105, the distance between the photosensitive member electrode 104 and the electric charge carrying member electrode 107 is not stable, whereby the intensity of the electric field applied to the photoconductive layer 1035becomes to be unstable, resulting in the intermittent of the image and the elongation of the image rear end portion.

The present invention is made on the basis of the aforementioned findings. The present invention aims that intensity of electric field applied to photoelectric transfer member such as the photoconductive layer 105 in the aforementioned apparatus is stable, whereby carrier generated in the photoelectric transfer member is spent fast to the electric discharge. The present invention also aims that distance between electrodes which cause electric discharge is held constant, whereby carrier generated in the photoelectric transfer member is spent fast to the electric discharge.

(1) According to a first aspect of the present invention, there is provided an electrostatic recording apparatus for forming an electrostatic image on an electric charge carrying member, comprising:

a photoelectric transfer member which generates carrier when being exposed to light;

a pair of bias electrodes between which the photoelectric transfer member is interposed, one of the bias electrodes being transparent;

an electric power supply for applying a voltage between the bias electrodes;

a floating electrode having a first area which comes into contact with the photoelectric transfer member and a second area which is opposed to the electric charge carrying member, the floating electrode being in no electrical connection with the bias electrodes; and an exposure means for exposing the photoelectric transfer member through the transparent bias electrode so that a carrier is generated in the photoelectric transfer member, thereby an electric discharge is caused from the second area of the floating electrode to the electric charge carrying member to form an electrostatic image on the electric charge carrying member.

In the electrostatic recording apparatus so constructed above, since the photoelectric transfer member is interposed between the pair of bias electrodes, the distance between the electrodes is constant. Thus, when applying a predetermined voltage between electrodes, an electric field generated in the photoelectric transfer member is in a desired stable condition, which causes generation of carrier due to exposure to the light to be stable and causes movement of the carriers to be fast.

In addition, since the first portion of the floating electrode comes into contact with the photoelectric transfer member, the carrier generated in the photoelectric transfer member move fast to the floating electrode to concentrate on it. Thus, the floating electrode increases in electric potential so that an electric discharge is caused from the second area of the floating electrode to the electric charge carrying member to form an electrostatic image corresponding to the light signal on the electric charge carrying member.

Consequently, it is eliminated that the electric discharge is caused intermittently or that the electric discharge is still continuously carried out after the completion of the exposure to the light. Therefore, all of the carriers generated in the photoelectric transfer member are spent fast to the electric discharge, thereby an electrostatic latent image reliably corresponding to the exposure to the light signal is recorded on the electric charge carrying member.

In the electrostatic recording apparatus according to the present invention, it is preferable that the second area of the floating electrode and the electric charge carrying member may be apart from each other with a predetermined distance and come into no contact with each other.

Preferably, the electrostatic recording apparatus may further comprise an acceleration electrode interposed between the second area of the floating electrode and the electric charge carrying member, and wherein an electric field is applied between the accelerated electrode and the second area of the floating electrode to accelerate ions generated by the electric discharge toward the electric charge carrying member.

(2) According to a second aspect of the present invention, there is provided an electrostatic recording apparatus for forming an electrostatic image on an electric charge carrying member, comprising:

- a photoelectric transfer member which generates carrier when being exposed to light;
- a pair of bias electrodes between which the photoelectric transfer member is interposed, one of the bias electrodes being transparent;
- an electric power supply for applying a voltage between the bias electrodes;
- a floating electrode having a first area which comes into contact with the photoelectric transfer member and a second area which is opposed to the electric charge carrying member, the floating electrode being in no electrical connection with the bias electrodes;
- a dielectric member which integrally supports the second area of the floating electrode so that the second area of the floating electrode comes into contact with the electric charge carrying member through the dielectric member; and
- an exposure means for exposing the photoelectric transfer member through the transparent bias electrode so that a carrier is generated in the photoelectric transfer member, thereby an electric discharge is caused from the second area of the floating electrode to the electric charge carrying member to form an electrostatic image on the electric charge carrying member.

The electrostatic recording apparatus so constructed above is similar to the aforementioned electrostatic recording apparatus according to the first aspect of the present invention except that the second area of the floating electrode comes into contact with the electric charge carrying member through the dielectric member. In this electrostatic recording apparatus, the distance between the electric charge carrying member and a portion of the floating electrode which is to be an electric discharge terminal is constant, more stable electric discharge than the aforementioned apparatus is caused from the electric discharge terminal of the second area of the floating electrode to the electric charge carrying member so that an electrostatic image corresponding to the light signal is formed on the electric charge carrying member.

In the electrostatic recording apparatus according to the present invention, it is preferable that the dielectric member may comprise a flexible material. In this case, since the dielectric member is flexible and follows the configuration of the electric charge carrying member to come into face-contact with it, a gap of electric discharge is maintained in more stable condition. Thus, it is possible to perform more stable recording of the electrostatic latent image.

Preferably, the electrostatic recording apparatus may further comprise a press means for pressing the dielectric member against the electric charge carrying member in order to ensure the face-contact between the dielectric member and the electric charge carrying member.

Preferably, the electrostatic recording apparatus may further comprises a shin film electrode which laminates the surface of the dielectric member which comes into face-contact with the electric charge carrying member, wherein a voltage is applied to the shin film electrode. In this case, an electrostatic force acts between the shin film electrode and the electric charge carrying member so that the dielectric member comes into close-contact with the electric charge carrying member.

BRIEF DESCRIPTION OF THE DRAWINGS

Further objects and advantages of the present invention will become clear from the following description taken in conjunction with the preferred embodiments thereof with reference to the accompanying drawings, in which.

DETAILED DESCRIPTION OF THE PREFERRED EMBODIMENTS

First Embodiment

Figure 1:
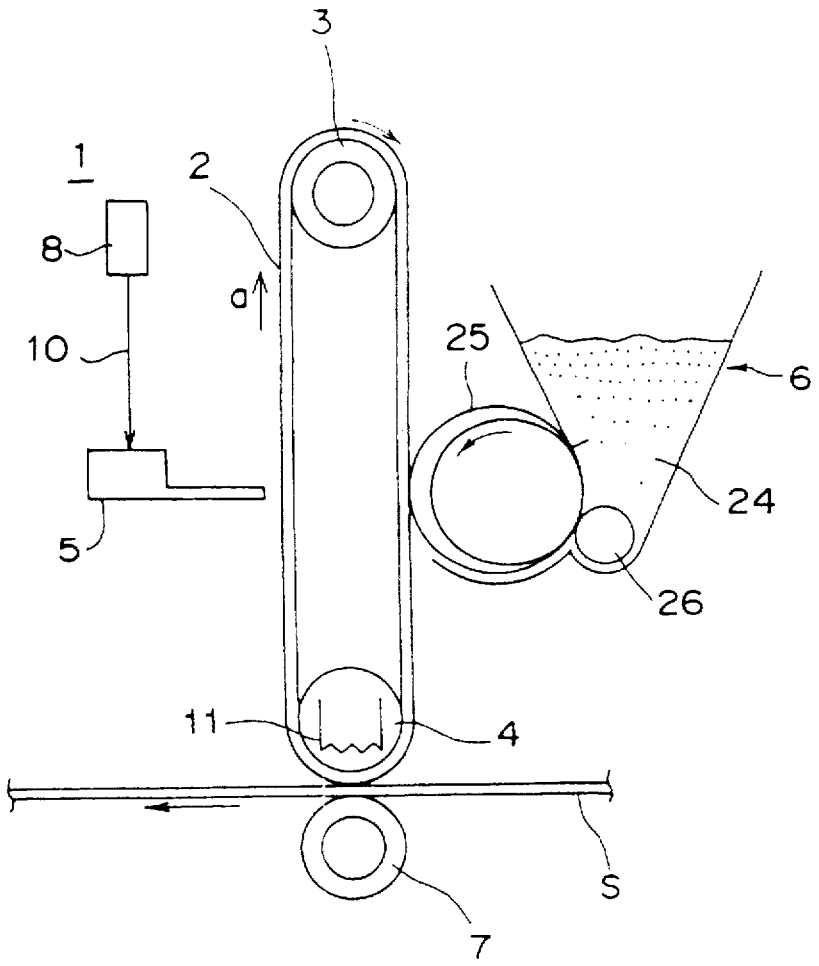
FIG. 1 is a sectional view of an image forming apparatus provided with an electrostatic recording head according to a first embodiment of the present invention.
Figure 2:
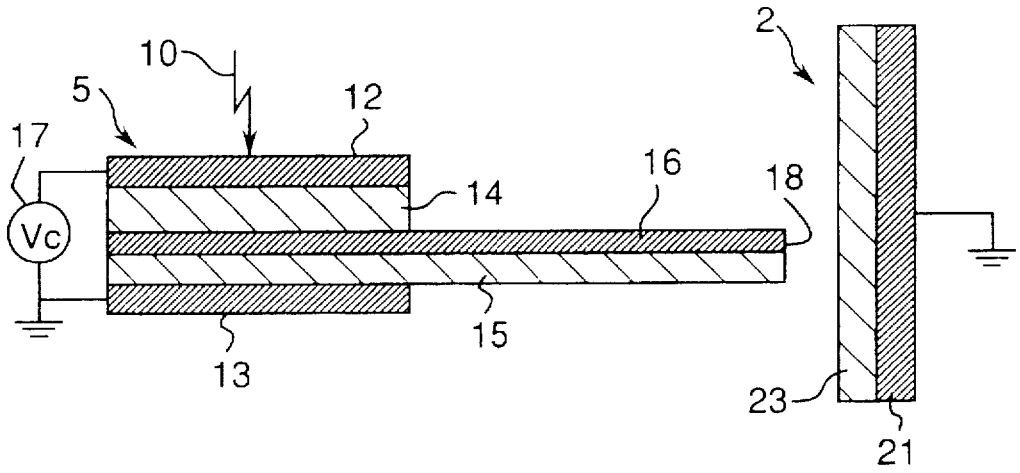
FIG. 2 is an enlarged sectional view of the electrostatic recording head of the image forming apparatus in FIG. 1.

FIG. 1 shows a schematic view of an image forming apparatus 1 provided with an electrostatic recording head 5 according to a first embodiment of the present invention, while FIG. 2 shows a partially enlarged sectional view of an essential part of the electrostatic recording head 5 and an image carrying belt 2.

In a center portion of the image forming apparatus 1 is arranged the image carrying belt 2 which serves as an electric charge carrying member. This image carrying belt 2 is made to run in a direction indicated by an arrow "a" by a driving roller 3 which is rotated by a drive unit (not shown) and a heating roller 4 provided in parallel with the driving roller 3.

As shown in FIG. 2, the image carrying belt 2 is provided by forming a dielectric layer 23 on a base 21 which serves as an conductive layer. In concrete, the dielectric layer 23 comprised of polyethylene terephthalate having a thickness of about 10 μm is provided on the base 21 comprised of a conductive film having a width of 25 cm and a perimeter of 30 cm. The base 21 is grounded by a conductive wire.

It is to be noted that the construction of the image carrying member is not limited to this kind of belt, and it may have a drum-like shape.

On the upper left side of the aforementioned image carrying belt 2 is disposed an optical system 8 for optically outputting an image, information to be recorded on the image carrying belt 2. In addition, Around the image carrying belt 2 are provided an electrostatic recording head 5 a developing unit 6 and a transfer roller 7 in this order in the direction indicated by the arrow "a" in FIG. 1.

The optical system 8 is constructed by arranging a semiconductor laser generator as a light source, a collimator lens, a polygon mirror, an Fθ-lens, a reflecting mirror and so forth in a housing and forming an exposure slit at a wall portion of the housing. This optical system 8 is constructed so that a laser light beam 10 generated by the semiconductor laser generator is applied through the exposure slit to the electrostatic recording head 5, thereby allowing image exposure to be achieved.

In this case, the direction in which the laser light beam 10 performs the scanning exposure is the widthwise direction of the image carrying belt 2 (in the front-back direction in FIG. 1), and this direction will be referred to as a main scanning direction hereinafter. Further, the direction in which the image carrying belt 2 runs (the vertical direction in FIG. 1) perpendicularly to the main scanning direction will be referred to as a sub-scanning direction.

The electrostatic recording head 5 as shown in FIG. 2, includes a pair of electrodes, namely, a transparent conductive layer 12 as a first electrode and an opposed conductive layer 13 as a second electrode. Between the transparent conductive layer 12 and the opposed conductive layer 13 are interposed a photosensitive layer 14 as a photoelectric transfer member which comes into contact with the transparent conductive layer 12, a dielectric layer 15 which comes into contact with the opposed conductive layer 13, and a floating electrode 16 which is disposed and electrically floating between the photosensitive layer 14 and the dielectric layer 15.

The transparent conductive layer 12 is comprised of an ITO film of conductive material and a polyamide resin film as an injection preventing layer. Further, to the ITO film of the transparent conductive layer 12 is connected a first power source 17.

The opposed conductive layer 13 is made of aluminum as a conductive metal material and is disposed opposite to the transparent conductive layer 12.

The photosensitive layer 14 is for negative charges and has a good sensitivity to light of a long wavelength such as a semiconductor laser light (having a wavelength of 780 nm) or an LED light (having a wavelength of 680 nm). The photosensitive layer 14 is a function separating type and is comprised of a charge generating layer (CGL) having a carrier pairs generating function and a charge transporting layer (CTL) having a free carriers transferring function. The photosensitive layer 14 is disposed so that the charge generating layer comes into contact with the injection preventing layer of the transparent conductive layer 12.

The dielectric layer 15 is made of polycarbonate as a dielectric and is disposed so as to come into contact with the opposed conductive layer 13. One end of the dielectric layer 15 extends toward the image carrying belt 2.

Figure 3A:
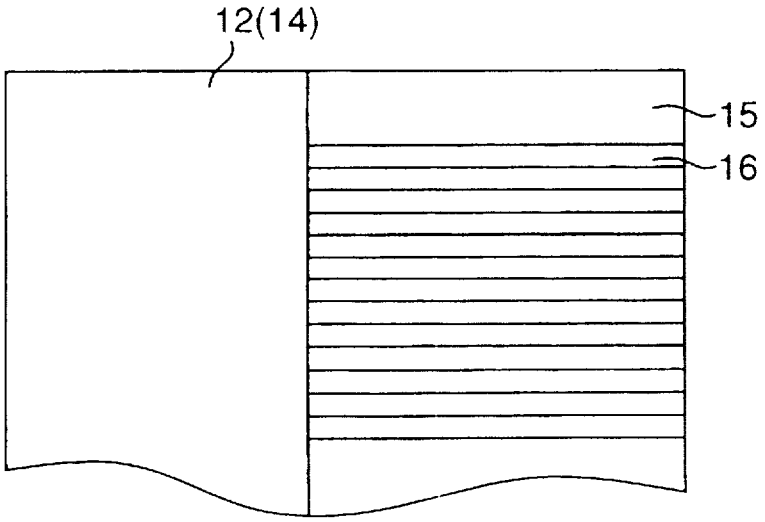
FIG. 3A is a plane view of the electrostatic recording head in FIG. 2.
Figure 3B:
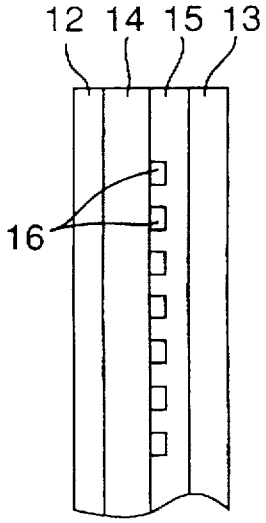
FIG. 3B is side view of the electrostatic recording head in FIG. 3A.

The floating electrode 16, as clearly shown in FIG. 3, comprises a plurality of electrodes provided on the dielectric layer 15 in parallel to each other at regular intervals in the main scanning direction. The floating electrode 16 is disposed so as to come into contact with the charge generating layer of the photosensitive layer 14. Each electrode of the floating electrode 16 corresponds to the picture element of print. Moreover, except the contact surface with the charge generating layer of the photosensitive layer 14, each electrode of the floating electrode 16 is surrounded by the dielectric layer 15 so that the charge does not move between adjoining electric discharge electrode.

The electrostatic recording head 5 and the image carrying belt 2 is so arranged that a end portion 18 of the floating electrode 16 of the electrostatic recording head 5 and the dielectric layer 23 of the image carrying belt 2 face each other via the air gap.

In order to keep the gap constant between the end portion 18 of the floating electrode 16 and the image carrying belt 2, a spacer may be provided between them. The spacer is preferably comprised of a material, which has a small coefficient of friction with respect to the image carrying belt 2 and hardly impairs it, such as fluororesin.

The aforementioned developing unit 6 is comprised of a toner storage section 24 for storing therein a single-component developer (referred to as a toner hereinafter), a developing sleeve 25 arranged in close vicinity to the image carrying belt 2 and a supply roller 26 for supplying the toner stored in the toner storage section 24 to the developing sleeve 25 while agitating the toner. The toner to be used in this developing unit 6 is a negative charge type and has a mean particle diameter of 10 μm obtained by kneading, pulverizing and classifying by a known method a mixture having bisphenol A polyester resin and carbon black as main ingredients.

To the developing sleeve 25 is applied an appropriate developing bias voltage for the purpose of preventing a background fogging and the like.

The transfer roller 7 faces the heating roller 4 via the image carrying belt 2 and is arranged in pressure contact with the image carrying belt 2. A recording paper S is made to pass between this transfer roller 7 and the image carrying belt 2.

In regard to the image forming apparatus 1 constructed as above, a latent image forming process will be described first.

A voltage (Vc) of 1.2 kV is applied to the transparent conductive layer 12 of the electrostatic recording head 5 by the first power source 17. Therefore, an electric field due to a voltage difference of 1.2 kV is formed between the transparent conductive layer 12 and the opposite conductive layer 13.

Figure 4:
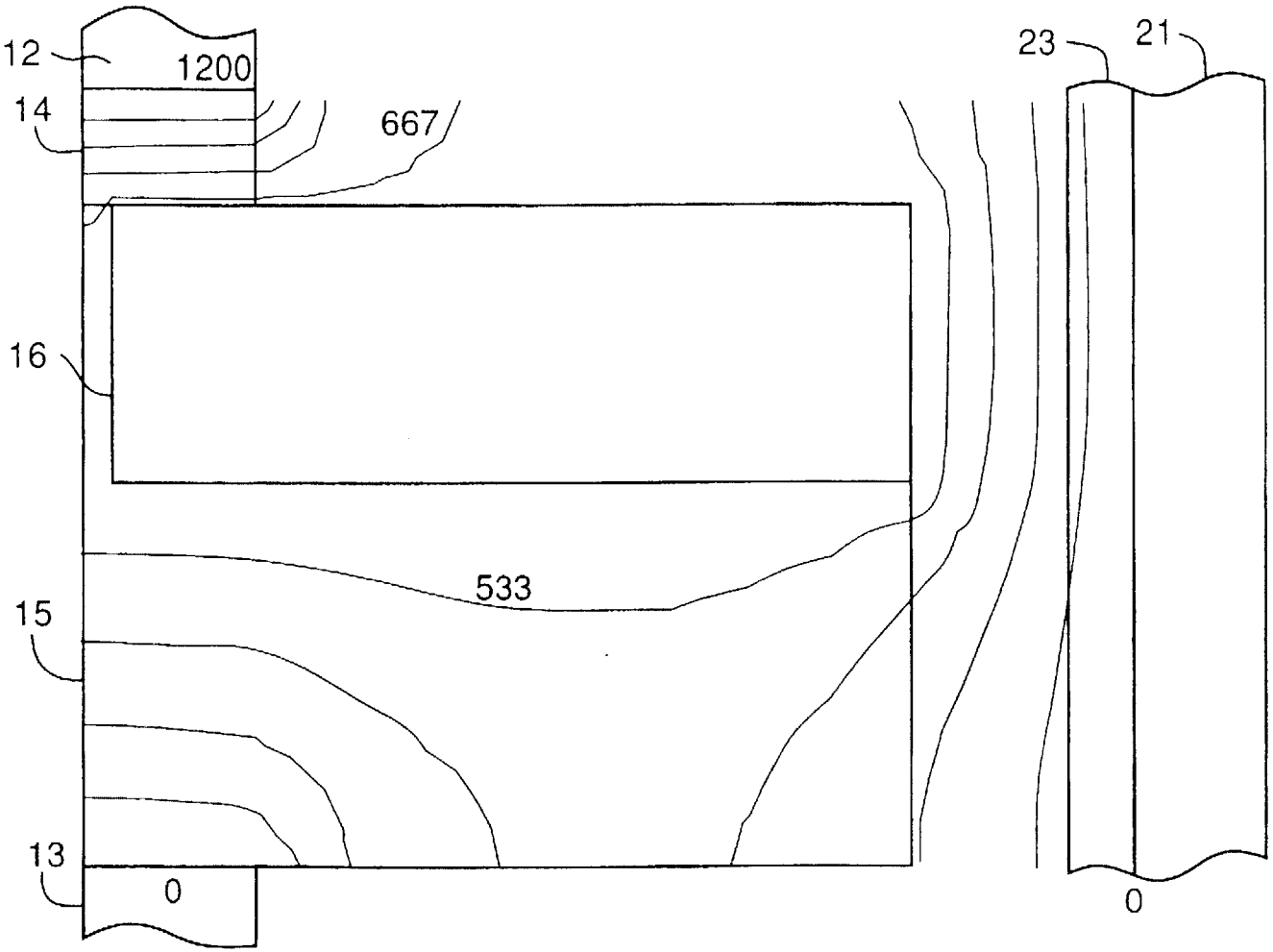
FIG. 4 is a graph showing an electric potential distribution of the electrostatic recording head according to the present invention.

FIG. 4 shows a distribution of electric potential in the electrostatic recording head 5 under the electric field. FIG.

5 shows a distribution of electric potential in an electrostatic recording head having no opposed conductive layer when applying a voltage to the transparent conductive layer 12 in the same manner as in FIG. 4.

Figure 5:
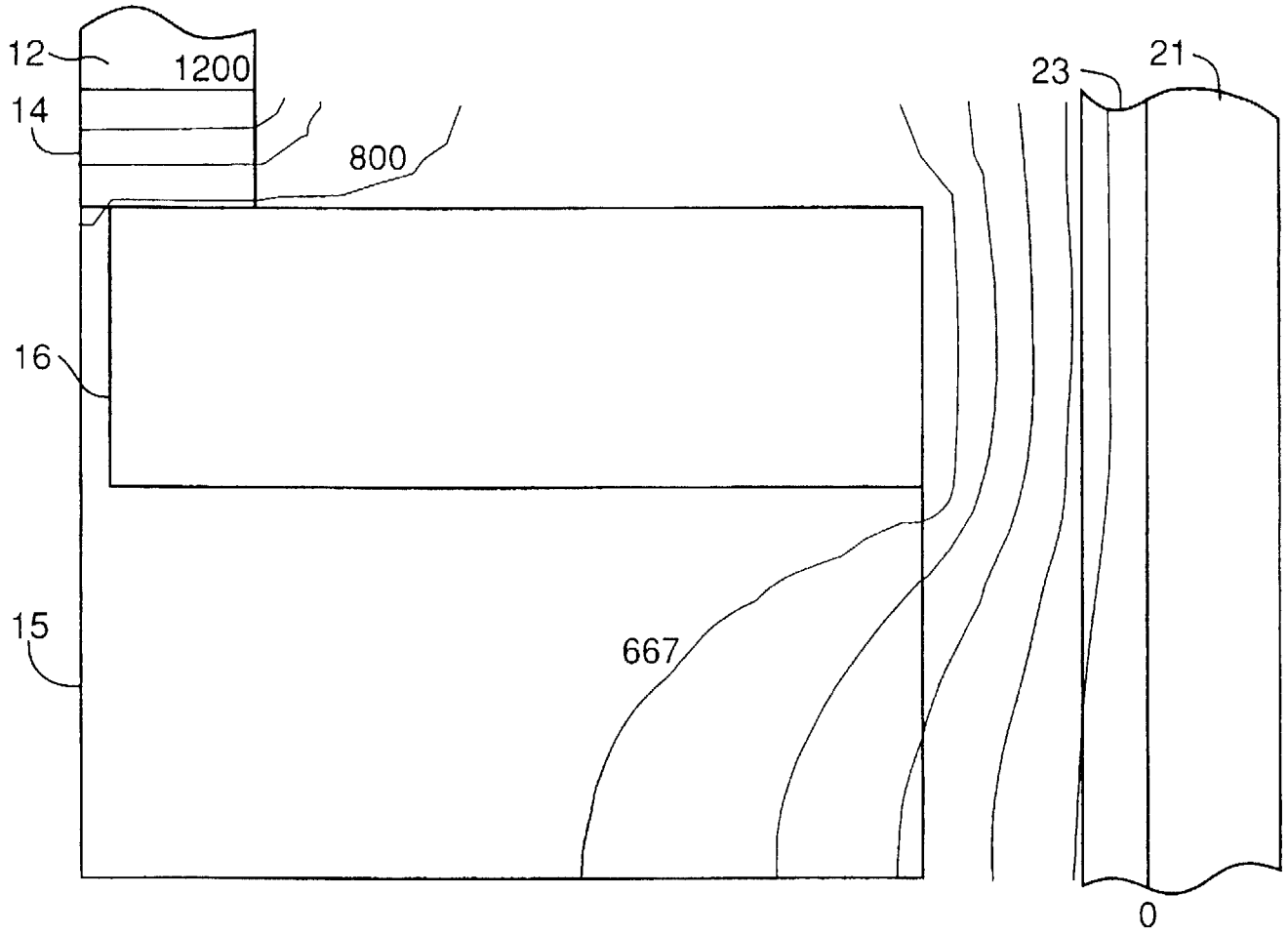
FIG. 5 is a graph showing an electric potential distribution of an electrostatic recording head of a comparative example without an opposed conductive layer.

As clear from comparing the distributions of electric potential in FIGS. 4 and 5, the equipotential line in the photosensitive layer 14 in the case of having the opposed electrode layer 13 is denser than that in the case of having no opposed electrode layer 13. This means that the electric field in the photosensitive layer 14 is increased by providing the opposed conductive layer 13.

Particularly, in the case of the apparatus having the opposed conductive layer 13 and the photosensitive layer 14 having a thickness of 20 μm, when applying a voltage of 1.2 kV to the transparent conductive layer 12, the electric potential of the floating electrode 16 is approximately 635 V and the electric field in the photosensitive layer 14 is (1200–635)/20 V/μm, i.e., approximately 28 V/μm. On the other hand, in the case of the apparatus having no opposed conductive layer, the electric potential of the floating electrode 16 is approximately 780 V and the electric field in the photosensitive layer 14 is (1200–780)/20 V/μm, i.e., approximately 21 V/μm. As a result of this, providing the opposite conductive layer 13 allows charges to be quickly generated and moved, which causes the electric discharge to take place faithfully corresponding to the irradiation of laser light as described hereinafter.

When the laser light beam 10 generated by the optical system 8 is applied for exposure to the electrostatic recording head 5 in the state in which the electric field is formed with the distribution of electrical distribution as in FIG. 4, the laser light beam 10 transmits itself through the transparent conductive layer 12 to reach the photosensitive layer 14. The charge generating layer of the photosensitive layer 14 generates carrier pairs upon absorbing light under the existence of an electric field. Among the generated carrier pairs, each freed carrier moves toward the opposite electrode having the inverse polarity. In this stage, each freed positive carrier moves through the inside of the charge transporting layer to the floating electrode 16. By this operation, the electric field in the air gap between the floating electrode 16 and the surface of the image carrying belt 2 increases. When this electric field exceeds a threshold value determined upon a Paschen's law, an electric discharge is generated and the surface of the dielectric layer 23 of the image carrying belt 2 corresponding to the position of exposure of the electrostatic recording head 5 is electrically charged, so that an electrostatic latent image is formed.

In this stage, although both the base 21 of the image carrying belt 2 and the opposed conductive layer 13 are grounded, the electric discharge occurs not between the floating electrode 16 and the opposed conductive layer 13 but between the floating electrode 16 and the base 21 of the image carrying belt 2. This reason is as follows. The dielectric (dielectric layer 15) is filled up between the floating electrode 16 and the opposed conductive layer 13, while the air gap is present between the floating electrode 16 and the base 21. Therefore, an electric potential difference necessary to cause the electric discharge between the floating electrode 16 and the opposed conductive layer 13 is higher than that necessary to cause the electric discharge between the floating electrode 16 and the base 21. Thus, only between the floating electrode 16 and the base 21 is caused the electric discharge to form a latent image on the image carrying belt 2.

A process after the formation of the latent image will be described as follows.

The electrostatic latent image formed on the image carrying belt 2 is conveyed to the developing section by the rotation of the driving roller 3 and the heating roller 4 and then developed with toner by the developing unit 6. Subsequently, a toner image formed on the image carrying belt 2 is further conveyed by the rotation of the driving roller 3 and the heating roller 4 and heated by a heating member 11 provided inside the heating roller 4 while being concurrently transferred onto a recording paper S by the transfer roller 7. In this stage, the toner image is fused and transferred, and therefore, no toner is left on the image carrying belt 2, meaning that almost whole the toner is transferred onto the recording paper S and concurrently fixed.

In the present embodiment, since the photosensitive layer 14 which is in general easily affected by heat is not disposed opposed to the image carrying belt 2, the photosensitive layer 14 is less affected by the heat added to the heating roller 4 of the image carrying belt 2. Thus, the construction and arrangement of the electrostatic recording head 5 increases in degree of freedom; the photosensitive layer 14 is prevented from deteriorating due to the heat; and the selection range of the material of photosensitive layer 14 is widened.

As the electrostatic recording head 5 of the aforementioned embodiment, one manufactured by the following method is used.

First, on a substantially plate-like substrate of polycarbonate which is to be the dielectric layer 15, the floating electrode 16 of slit-pattern as shown in FIG. 3 was formed by vapor depositing aluminum in a state in which a mask sheet is tightly fit on the surface of the substrate and thereafter removing the mask.

Then, a coating liquid in which eight parts by weight of a hydrazone compound expressed by the following structural formula (Formula 1), 0.1 part by weight of an orange pigment and 10 parts by weight of polycarbonate resin are dissolved in a solvent comprised of 180 parts by weight of tetrahydrofuran was coated on the dielectric layer 15 with the slit-pattern floating electrode 16 by the dipping method and dried, so that the charge transporting layer having a film thickness of 21 μm was formed.

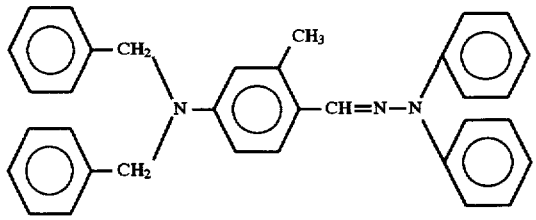

Then, a photosensitive paint as described below was coated on the charge transporting layer by the dipping method to form a charge generating layer having a film thickness of 0.15 μm after drying, so that the photosensitive layer 14 was formed.

The photosensitive paint used for the charge generating layer was obtained in a manner that one part by weight of τ (tau) type metal-free phthalocyanine, two parts by weight of polyvinyl butyral resin and 100 parts by weight of tetrahydrofuran were put in a ball mill pot and dispersed for 24 hours. The photosensitive paint has a viscosity of 15 cp at a temperature of 20° C. in this stage. As the polyvinyl butyral resin, one which has a degree of acetylation of not greater than three molar percent, a degree of butylation of 70 molar percent and a degree of polymerization of 1000 was used.

In the aforementioned embodiment, although the charge generating layer was formed by coating with the photosensitive material dissolved in the solvent, it may be formed by vapor depositing the photosensitive material.

Then, an about 0.5 μm thick of polyamide resin layer was coated as an injection preventing layer on the forementioned photosensitive layer 14 by the dipping method and the ITO film was further formed by a thickness of about 0.2 μm by the known ion plating method (it is assumed that the ITO film has a sheet resistivity of about 100 Ω/□), so that the transparent conductive layer 12 was formed.

On the other hand, on the bottom surface of dielectric layer 15 of polycarbonate, the opposed conductive layer 13 was formed by vapor depositing aluminum so as to oppose to the transparent conductive layer 12.

In regard to the construction of the photosensitive layer 14, it is proper to appropriately select a known material for the charge generating material, charge transfer material, binding resin and additives according to purposes. In addition, the photosensitive material is not limited to the organic material, and it is acceptable to use an inorganic material such as zinc oxide, cadmium sulfide, selenium based alloy, amorphous silicon based alloy or amorphous germanium alloy. Furthermore, it is acceptable to provide a known undercoating layer for the purpose of improving the charge characteristic, image quality and adhesion to the base.

Instead of ITO film used for the transparent conductive layer 12, a transparent conductive material may be used. In this case, as the transparent conductive material is preferably adopted such a material that a sheet resistivity is less than about 1000 Ω/□ in order to avoid a voltage drop. The method of forming the conductive layer is not limited to the aforementioned method, and it is acceptable to form a conductive layer by a printing method or a sputtering method instead of the ion plating method and the vapor deposition.

As to the injection preventing layer, its material is not limited to the polyamide resin, and it is acceptable to use a known transparent material.

As to the dielectric layer 15 and dielectric layer 23, its material is not limited to the polycarbonate or the polyethylene terephthalate, and it is acceptable to use a known dielectric material such as acrylic or polypropylene. It is to be noted that the electric resistivity of the material of the aforementioned dielectric layer 23 is preferably set to $10^{11}$ Ωcm or higher in order to prevent the reduction of the charge potential with the elapse of time. There is no limitation on the thickness of the dielectric layer 25 if it is within the range in which there is no problem of strength in terms of practical handling and durability, and it is generally considered appropriate that the thickness is 2 to 100 μm.

As an another method of manufacturing the electrostatic recording head 5, it is preferable to use a method of laminating the transparent conductive layer 12, photosensitive layer 14, floating electrode 16, dielectric layer is and the opposite conductive layer 13 in this order on a substrate such as glass.

Figure 6:
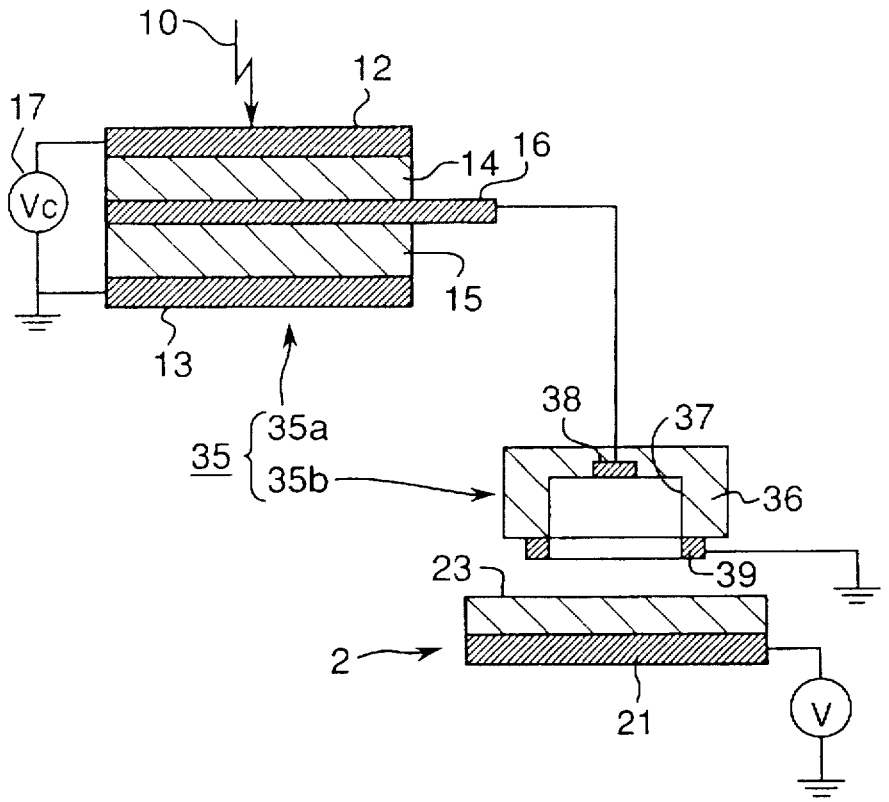
FIG. 6 is an enlarged sectional view of the electrostatic recording head according to a variation of the first embodiment of the present invention.
Figure 7:
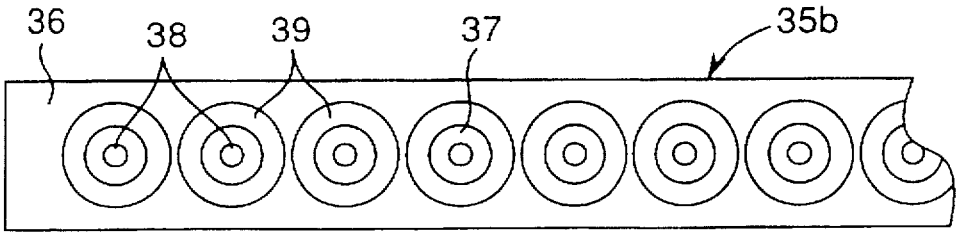
FIG. 7 is a front view of the discharge portion of the electrostatic recording head in FIG. 6.

FIG. 6 is a view similar to that of FIG. 2 and shows an electrostatic recording head 35 as a variation of the recording head 5 in FIG. 2 according to the aforementioned first embodiment.

The electrostatic recording head 35 as shown in FIG. 6 is comprised of a photoelectric transfer portion 35*a* and an electric discharge portion 35*b*. The photoelectric transfer portion 35*a* has a similar construction to the electrostatic recording head 5 in FIG. 2. A same numeral is affixed to the similar portion so as to omit the explanation thereof.

Figure 8:
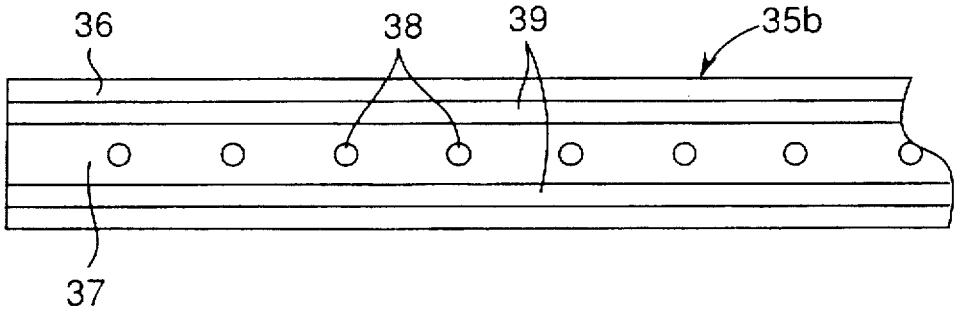
FIG. 8 is a front view of another variation of the discharge portion in FIG. 7.

The electric discharge portion 35*b* is disposed independently from the photoelectric transfer portion 35*a*. The electric discharge portion 35*b* comprises a holding base 36. In the holding base 36 are formed a plurality of recessed portions 37 in a line. The number of the recessed portions 37 is consistent with that of the floating electrode 16. On the bottom of each recessed portion 37 is provided an electric discharge terminal 38. In addition, on the open edge of each recessed portion 37 is disposed a ring-like acceleration electrode 39 for accelerating an electric discharge from the electric discharge terminal 38. The electric discharge terminal 38 is connected to the floating electrode 16 via an electric conductor so as to be equipotential to the floating electrode 16. The shape of the acceleration electrode 39 is not limited to the ring-like shape, and it is acceptable to form in such a shape that an electric discharge occurs between the acceleration electrode 39 and the electric discharge terminal 38 and a part of charge reaches at the image carrying belt 2, for example, in a mesh-like shape or in a parallel line-like shape as shown in FIG. 8.

In regard to the electrostatic recording head 5 constructed as above, a voltage (Vc) of 1.2 kV is applied to the transparent conductive layer 12, the opposed conductive layer 13 and the acceleration electrode 39 are grounded, and a voltage of – (minus) 1 kV is applied to the base 21 of the image carrying belt 2.

In this condition, when a laser light 10 is irradiated to the photosensitive layer 14, the floating electrode 16 including the electric discharge terminal 38 increases in electric potential so that an electric discharge occurs between the electric discharge terminal 38 and the acceleration electrode 39, whereby a part of charge is drawn to the image carrying belt 2 to form an electrostatic latent image on the dielectric layer 23.

By providing the acceleration electrode 39, a long distance between the electric discharge terminal 38 of the floating electrode 16 and the image carrying belt 2 is ensured and a permissible range of the distance is widened. Thus, even if the distance between the electric discharge terminal 38 and the image carrying belt 2 varies a little due to an irregular or a deformation of the image carrying belt 2, it is acceptable. Therefore, the work in both design and manufacturing stages become easier, which enables the cost reduction. Moreover, the electric discharge terminal 38 of the floating electrode 16 and the acceleration electrode 39 keep a constant distance, the electric discharge between them is carried out in more stable condition.

In addition, the electrostatic recording head 35 is separated into the photoelectric transfer portion (main body) 35*a* and the electric discharge portion 35*b*. Therefore, it is possible to freely decide the arrangement of the photoelectric transfer portion 35*a*, which increases degree of freedom in design. It is also possible to arrange so that the photoelectric transfer portion 35*a* is not affected by the heat of image carrying belt 2 and, on the other hand, to increase the temperature of transfer and fixation of the toner image. These enables to attempt a wide selection range of material, an easiness of design and a low cost.

As another variations of the first embodiment, in the electrostatic recording head 35 in FIG. 6, a construction having no acceleration electrode 39, that is, such a construction that the electric discharge terminal 38 is independent from the photoelectric transfer portion 35*a* will be acceptable. Moreover, in the electrostatic recording head 5 in FIG.

2, such a construction that an acceleration electrode is provided adjacent to the end portion 18 of the floating electrode 16 will be acceptable.

Second Embodiment

Figure 9:
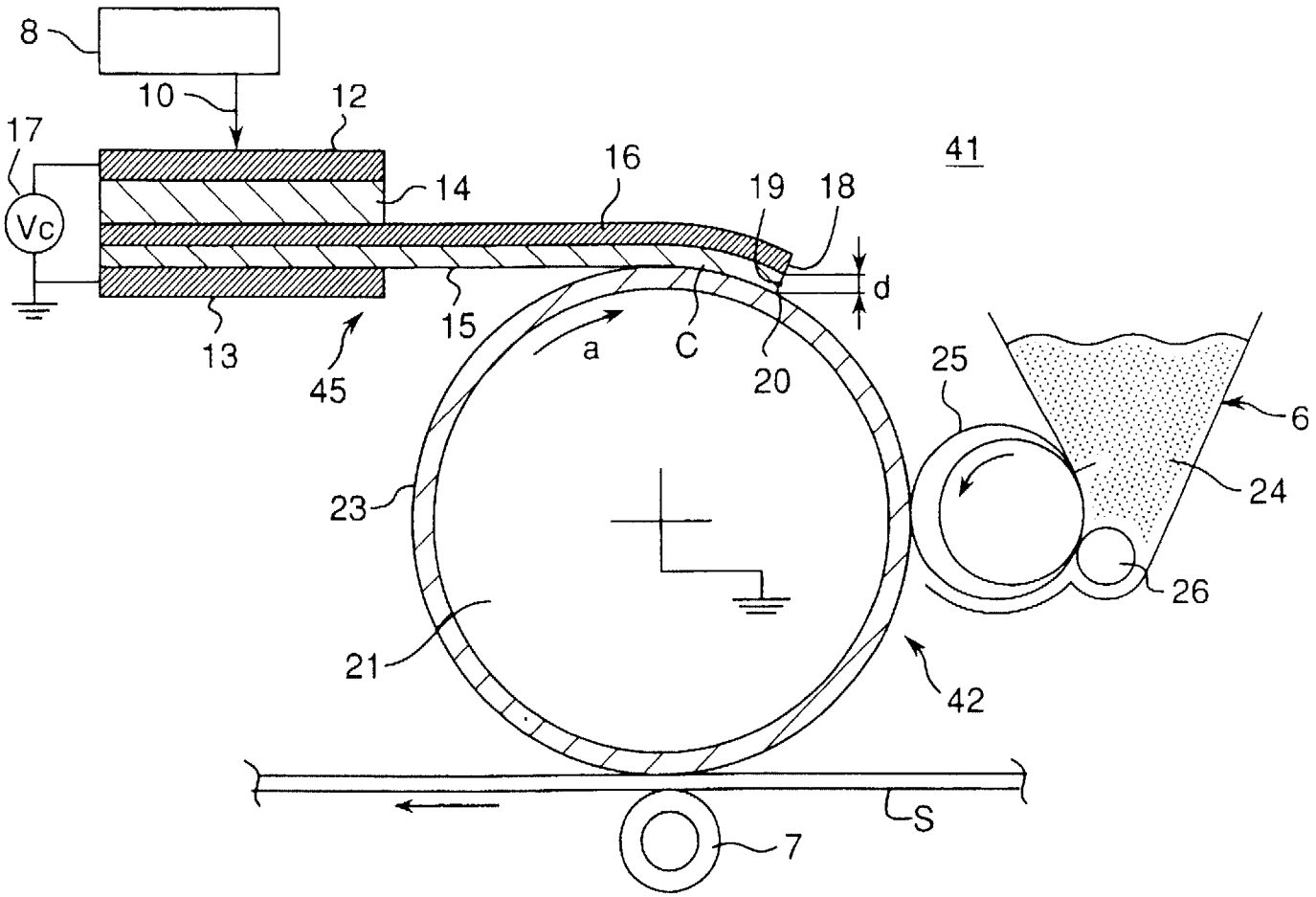
FIG. 9 is a sectional view of an image forming apparatus provided with an electrostatic recording head according to a second embodiment of the present invention.

FIG. 9 shows a schematic view of an image forming apparatus 41 provided with an electrostatic recording head 45 according to a second embodiment of the present invention.

The image forming apparatus 41 has a similar construction to the image forming apparatus 1 according to the aforementioned first embodiment except an image carrying roller 42 and a dielectric layer 15 and an floating electrode 16 of the electrostatic recording head 45. A same numeral is affixed to the similar portion so as to omit the explanation thereof.

The image carrying roller 42 is provided by forming a dielectric layer 23 on a base 21 which serves as an conductive layer. In concrete, the dielectric layer 23 comprised of polyester having a thickness of about 10 μm is provided on the base 21 comprised of a conductive cylindrical roller having a width of 250 mm and a diameter of 30 mm. The base 21 is grounded by a conductive wire.

The electrostatic recording head 45 has almost same construction as the first embodiment in FIG. 2. That is, between a pair of electrodes, namely, a transparent conductive layer 12 and an opposed conductive layer 13 are interposed a photosensitive layer 14, a dielectric layer 15 and an floating electrode 16.

The dielectric layer 15 is made of polyethylene terephthalate film as a dielectric and have a flexibility. The dielectric layer 15 is disposed so as to come into contact with the opposed conductive layer 13. One end of the dielectric layer 15 extends toward the image carrying roller 42 and follows the circumferential shape of the image carrying roller 42 so that the chip end 19 and its adjacent portion C of the dielectric layer 15 comes into face-contact with the surface of the image carrying roller 42.

Figure 10:
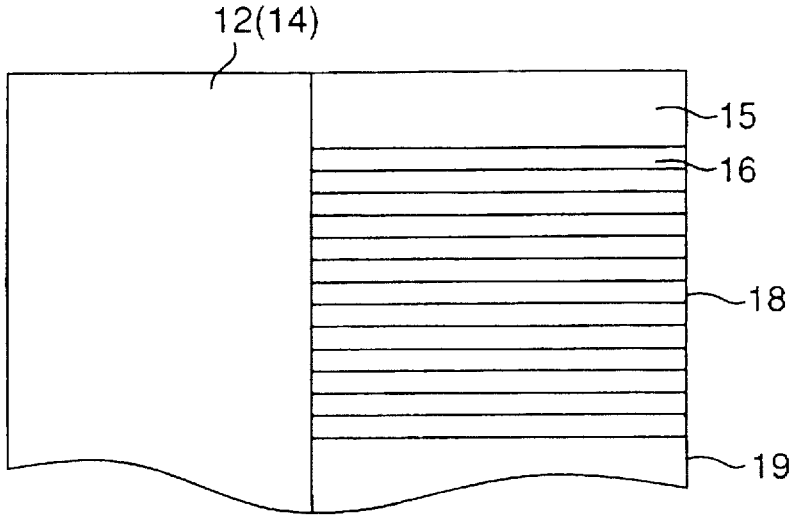
FIG. 10 is a plane view of the electrostatic recording head in FIG. 9.

The floating electrode 16 is made of metal thin film and, as clearly shown in FIG. 10, comprises a plurality of electrodes in the same manner as in FIG. 3 (A). One end of each electrode of the floating electrode 16 extends on the dielectric layer 15 toward the image carrying roller 42 so that the end portion 18 meets with the chip end 19 of the dielectric layer 15. Thus, the floating electrode 16 follows the dielectric layer 15 and flexes along the surface of the image carrying roller 42.

As a result, one end portion of the floating electrode 16 comes into face-contact with the image carrying roller 42 via the dielectric layer 15. Thus, the end portion 18 of the floating electrode 16 of the electrostatic recording head 45 is arranged adjacent to the dielectric layer 23 of the image carrying roller 42 at a point 20 via an air gap d as shown in FIG. 9.

In the image forming apparatus 41 constructed as above, when applying a voltage (Vc) of 1. 2 kV between the transparent conductive layer 12 and the opposed conductive layer 13, the electric potential of the floating electrode 16 becomes several hundred volts. Thus, an electrostatic force acts between the floating electrode 16 and the image carrying roller 42, which causes the floating electrode 16 to flex along with the dielectric layer 15 and follow the shape of the image carrying roller 42.

Next, when the laser light beam 10 is applied for exposure to the electrostatic recording head 45, an electric discharge occurs between the end portion 18 of the electric discharge electrode 16 and the dielectric layer 23 of the image carrying roller 42 in the same manner as the aforementioned first embodiment, so that an electrostatic latent image is formed on the image carrying roller 42.

The electrostatic recording head 45 of the second embodiment may be manufactured in the same manner as the first embodiment except using a polyethylene terephthalate film having a thickness of 20 μm as a dielectric layer 15 and bonding a aluminum plate having a thickness of 3 mm as the opposite conductive layer 13 on the dielectric layer 15.

As to the dielectric layer 15, a material having a flexibility, a characteristic of following a shape, and an abrasion resistance is preferable. Although a hard material may be used, such material is necessary to form so as to mate with the surface shape of the image carrying roller 42.

In addition, the dielectric layer 15 may exist at least at the portion where the dielectric layer 15 comes into face-contact with the image carrying roller 42. In other words, the dielectric layer 15 may be provided only on the portion adjacent to the end chip portion 19. In this case, it is necessary to arrange the position of the dielectric layer 15 so as not to have the electric discharge caused between floating electrode 16 and the opposed conductive layer 13.

Figure 11:
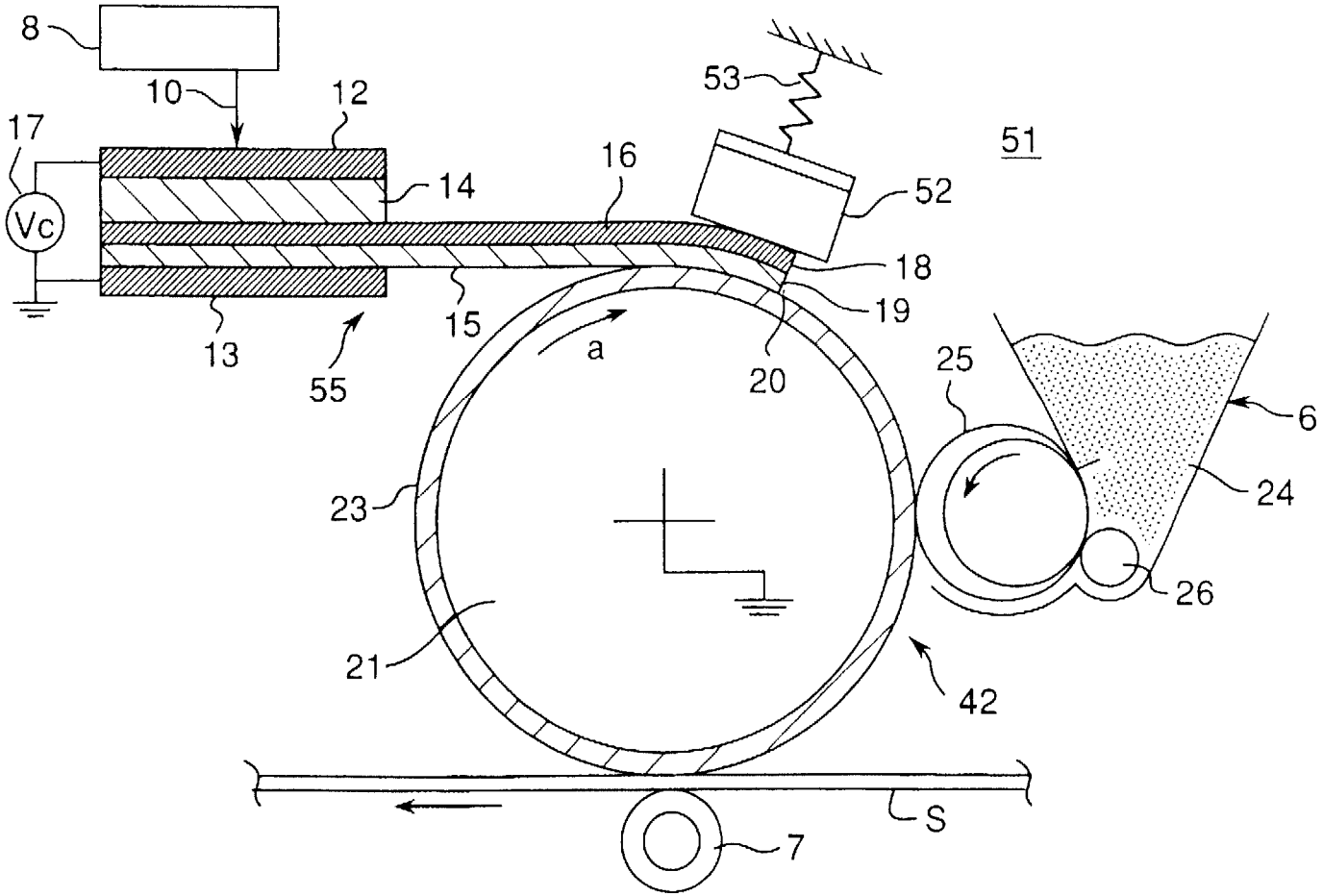
FIG. 11 is a sectional view of an image forming apparatus provided with an electrostatic recording head according to a first variation of the second embodiment of the present invention.
Figure 12:
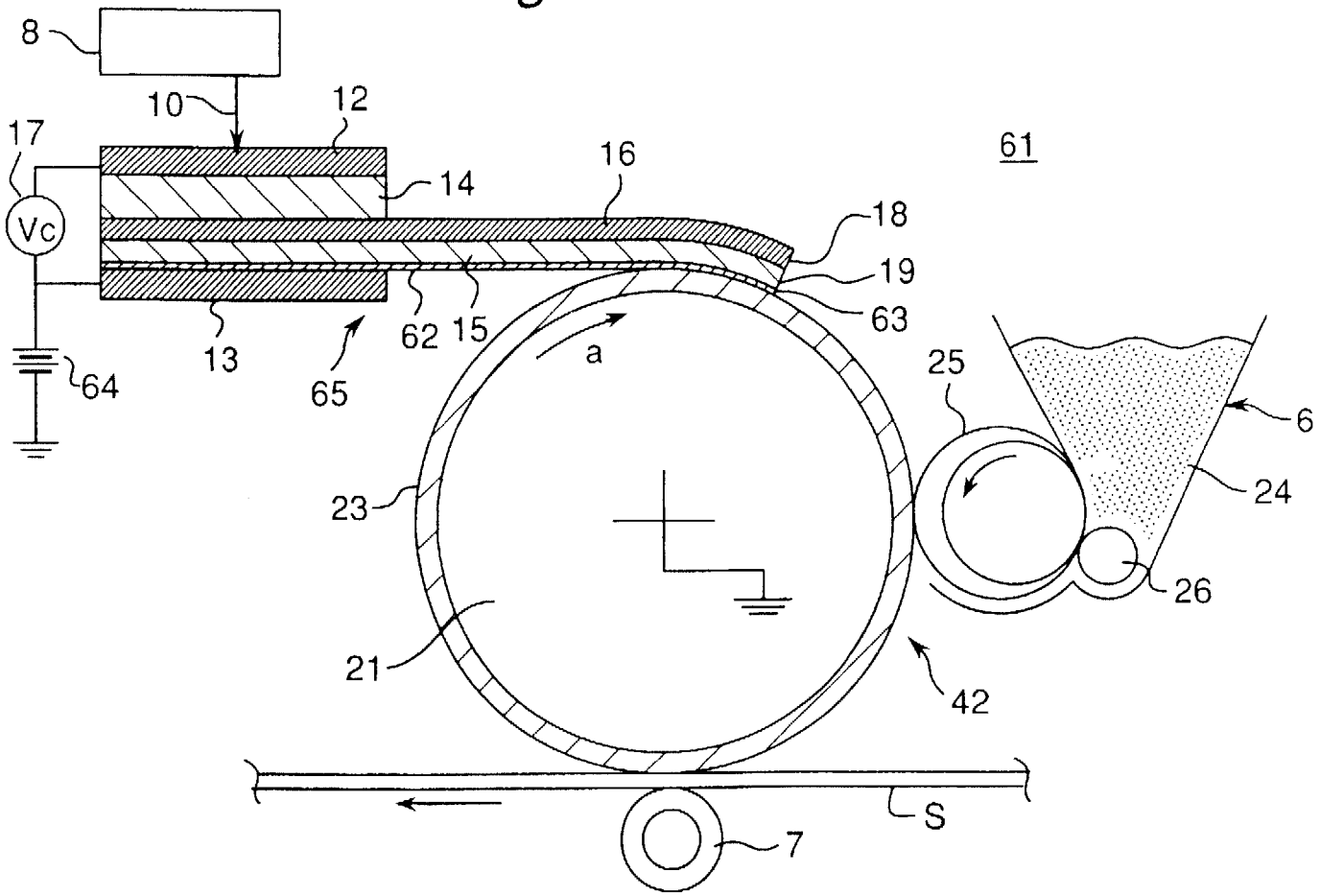
FIG. 12 is a sectional view of an image forming apparatus provided with an electrostatic recording head according to a second variation of the second embodiment of the present invention.
Figure 13:
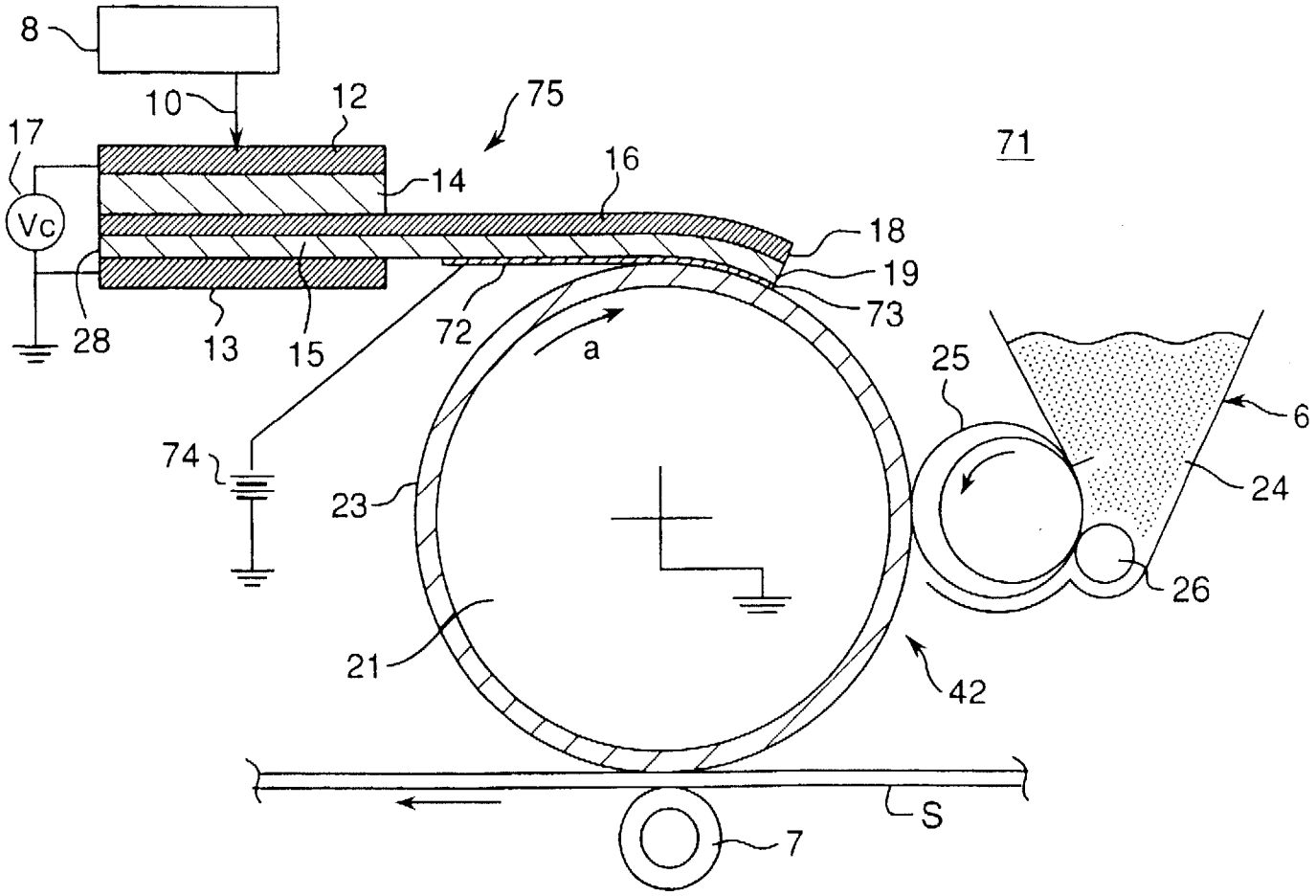
FIG. 13 is a sectional view of an image forming apparatus provided with an electrostatic recording head according to a third variation of the second embodiment of the present invention.
Figure 14:
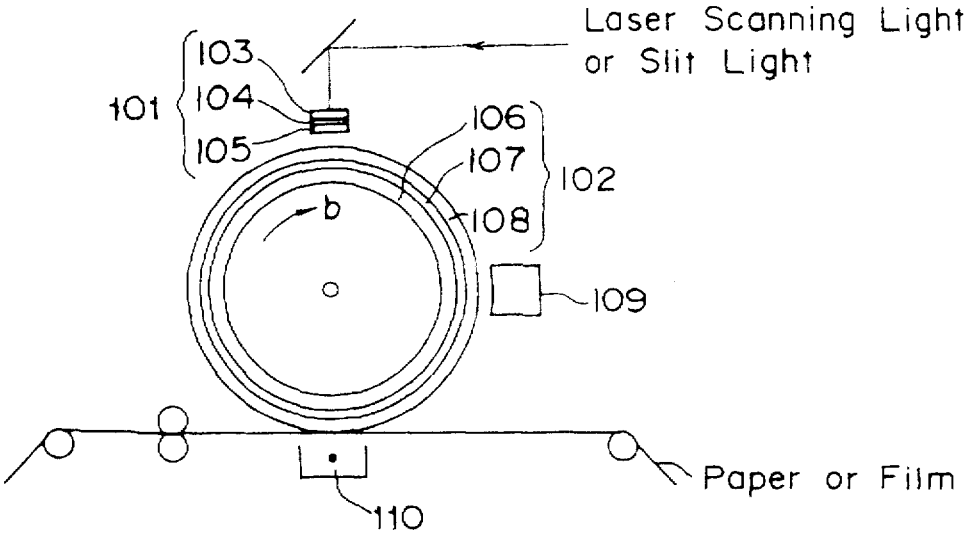
Fig. 14 PRIOR ART
FIG. 14 is a sectional view of an image forming apparatus of prior art.

FIGS. 11–13 are views similar to that of FIG. 9 and show variations of the image forming apparatus 41 according to the aforementioned second embodiment. Each image forming apparatus 51, 61, 71 has a substantially same construction as in FIG. 9 except especially noted, and so a same numeral is affixed to the corresponding portion so as to omit the explanation thereof.

FIG. 11 shows an image forming apparatus 51 of the first variation. In the image forming apparatus 51, a press member 52 made of resin form having a flexibility such as sponge is provided on the floating electrode 16. The press member 52 is urged by a spring 53 toward the floating electrode 16.

Thus, the chip end portion 19 of the dielectric layer 15 comes into face-contact with the image carrying roller 42 in a reliably stable condition, whereby the distance between the end portion 18 of the floating electrode 16 and the dielectric layer 23 of the image carrying roller 42 is hold constant, and the electrostatic recording is steadily performed.

FIG. 12 shows an image forming apparatus 61 of the second variation. In the image forming apparatus 61, a thin film conductive layer 62 is formed on the bottom surface of the dielectric layer 15 by vapor depositing aluminum. The thin film conductive layer 62 adheres to the opposed conductive layer 13 so as to be equipotential to the opposed conductive layer 13.

The opposed conductive layer 13 is connected to a second electric supply 64 so that a voltage of 200 V is applied to both the opposed conductive layer 13 and the thin film conductive layer 62. To the transparent conductive layer 12 is applied a voltage of 1200 V from the first electric supply 17 and a voltage of 200 V from the second electric supply 64, that is, a voltage of 1400 V in total. In the photosensitive layer 14, an electric field is formed due to a voltage difference of 1200 V between the transparent conductive layer 12 and the opposite conductive layer 13.

When a laser light 10 is irradiated to the photosensitive layer 14, the electric potential of the floating electrode 16 increases. Thus, the electric discharge occurs between the end portion 18 of the floating electrode 16 and the end portion 63 of the thin film conductive layer 62, whereby a part of charge is drawn to the dielectric layer 23 of the image carrying roller 42 to form an electrostatic latent image.

Since the thin film conductive layer 62 has an electric potential of 200 V, an electrostatic force acts between the thin film conductive layer 62 and the image carrying roller 42, which causes the thin film conductive layer 62 to adhere to the image carrying roller 42. The adhesion force increase the characteristic of following a shape relative to the image carrying roller 42. As the electric discharge occurs between the end portion 18 of the floating electrode 16 and the end portion 63 of the thin film conductive layer 62, the electric discharge is stable itself.

FIG. 13 shows an image forming apparatus 71 of the third variation. In the image forming apparatus 71, a thin film conductive layer 72 is formed by vapor depositing aluminum on the bottom surface of the dielectric layer 15 in the area of 25 mm from the chip end portion 19. Thus, the thin film conductive layer 72 does not adhere to the opposed conductive layer 13, so that the thin film conductive layer 72 is possible to have a different potential from the opposed conductive layer 13.

To the thin film conductive layer 72, a second electric supply 74 is connected and a voltage of 200 V is applied. Thus, the thin film conductive layer 72 adheres to the image carrying roller 42 due to an electrostatic force between the thin film conductive layer 72 and the image carrying roller 42 in the same manner as in FIG. 12. To the transparent conductive layer 12 is applied a voltage of 1200 V from the first electric supply 17. Therefore, the electrostatic latent image recording process is same as in FIG. 12.

Thus, the voltage to be applied to the transparent conductive layer 12 is suppressed lower than that in FIG. 12.

Other Embodiment

Although the semiconductor laser is used as a light source for exposing the electrostatic recording head 5, 35, 45, 55, 65, 75 to light in either one of the aforementioned embodiments and variations, the present invention is not limited to this, and a known exposure method such as an LED system, an LCD shutter system or a PLZT system can be used so long as it can appropriately expose the electrostatic recording head to light. Furthermore, it is a matter of course that an unexposed portion can be developed without developing an exposed portion by changing the characteristics of the developer and the like.

Although the electrostatic recording heads 5, 35, 45, 55, 65, 75 are applied to the image forming apparatus in either one of the aforementioned embodiments and variations, the present invention is not limited to this, and the electrostatic recording head is also applied to a micro switch for turning on and off a liquid crystal, a memory for storing a data by utilizing electrostatic.

Although the present invention has been fully described by way of the examples with reference to the accompanying drawing, it is to be noted here that various changes and modifications will be apparent to those skilled in the art. Therefore, unless such changes and modifications otherwise depart from the spirit and scope of the present invention, they should be construed as being included therein.

What is claimed is:

1. An electrostatic recording apparatus for forming an electrostatic image on an electric charge carrying member, comprising:

a photoelectric transfer member which generates carrier when being exposed to light;

a pair of bias electrodes between which the photoelectric transfer member is interposed, one of the bias electrodes being transparent;

an electric power supply for applying a voltage between the bias electrodes;

a floating electrode having a first area which comes into contact with the photoelectric transfer member and a second area which is opposed to the electric charge carrying member, the floating electrode being in no electrical connection with the bias electrodes; and an exposure means for exposing the photoelectric transfer member through the transparent bias electrode so that a carrier is generated in the photoelectric transfer member, thereby an electric discharge is caused from the second area of the floating electrode to the electric charge carrying member to form an electrostatic image on the electric charge carrying member.

2. The electrostatic recording apparatus as in claim 1, wherein the second area of the floating electrode and the electric charge carrying member are apart from each other with a predetermined distance and come into no contact with each other.

3. The electrostatic recording apparatus as in claim 1, further comprising an acceleration electrode interposed between the second area of the floating electrode and the electric charge carrying member, and wherein an electric field is applied between the accelerated electrode and the second area of the floating electrode to accelerate ion generated by the electric discharge toward the electric charge carrying member.

4. The electrostatic recording apparatus as in claim 1, wherein the floating electrode comprises a plurality of electrodes insulated from each other.

5. The electrostatic recording apparatus as in claim 1, wherein the electric charge carrying member is rotatably operated, the second area of the floating electrode extends in vertical direction to the surface of the electric charge carrying member, and wherein the floating electrode comprises a plurality of electrodes insulated from each other.

6. The electrostatic recording apparatus as in claim 1, further comprising an electrostatic image visualizing means, the electrostatic image visualizing means visualizing an electrostatic image on the electric charge carrying member by bringing a charged toner into contact with an electric charge on the electric charge carrying member.

7. An electrostatic recording apparatus for forming an electrostatic image on an electric charge carrying member, comprising:

a photoelectric transfer member which generates carrier when being exposed to light;

a pair of bias electrodes between which the photoelectric transfer member is interposed, one of the bias electrodes being transparent;

an electric power supply for applying a voltage between the bias electrodes;

a floating electrode having a first area which comes into contact with the photoelectric transfer member and a second area which is opposed to the electric charge carrying member, the floating electrode being in no electrical connection with the bias electrodes;

a dielectric member which integrally supports the second area of the floating electrode so that the second area of the floating electrode comes into contact with the electric charge carrying member through the dielectric member; and an exposure means for exposing the photoelectric transfer member through the transparent bias electrode so that a carrier is generated in the photoelectric transfer member, thereby an electric discharge is caused from the second area of the floating electrode to the electric charge carrying member to form an electrostatic image on the electric charge carrying member.

8. The electrostatic recording apparatus as in claim 7, wherein the floating electrode comprises a plurality of electrodes insulated from each other.

9. The electrostatic recording apparatus as in claim 7, wherein the electric charge carrying member is rotatably operated, the second area of the floating electrode extends in vertical direction to the surface of the electric charge carrying member, and wherein the floating electrode comprises a plurality of electrodes insulated from each other.

10. The electrostatic recording apparatus as in claim 7, further comprising an electrostatic image visualizing means, the electrostatic image visualizing means visualizing an electrostatic image on the electric charge carrying member by bringing a charged toner into contact with an electric charge on the electric charge carrying member.

11. The electrostatic recording apparatus as in claim 7, wherein the dielectric member comprises a flexible material.

12. The electrostatic recording apparatus as in claim 7, further comprising a press means for pressing the dielectric member against the electric charge carrying member.

13. The electrostatic recording apparatus as in claim 7, further comprising a thin film electrode which laminates the surface of the dielectric member which comes into face-contact with the electric charge carrying member, wherein a voltage is applied to the thin film electrode.

* * * * *